US005517826A

United States Patent [19]

Duffy

[11] Patent Number: 5,517,826

[45] Date of Patent: May 21, 1996

[54] REFRIGERATED MERCHANDISER WITH MODULAR EXTERNAL FRAME STRUCTURE

[75] Inventor: Martin J. Duffy, St. Louis, Mo.

[73] Assignee: Hussmann Corporation, Bridgeton, Mo.

[21] Appl. No.: 404,036

[22] Filed: Mar. 14, 1995

[51] Int. Cl.[6] ..... A47F 3/04

[52] U.S. Cl. ..... 62/256; 62/297; 312/116; 312/265.1

[58] Field of Search ..... 312/116, 265.1, 312/408; 62/256, 297, 440

[56] References Cited

U.S. PATENT DOCUMENTS

| | | | |
|---|---|---|---|
| Re. 20,610 | 1/1938 | Darbyshire | 220/9 |
| 2,066,312 | 1/1937 | Bales | 62/89.5 |
| 3,297,374 | 1/1967 | Radek | 312/265.1 |
| 3,588,214 | 6/1971 | Stimaniglio | 312/214 |
| 4,352,275 | 10/1982 | Ibrahim | 62/256 |
| 4,369,632 | 1/1983 | Abraham | 62/82 |
| 4,370,866 | 2/1983 | Abraham | 62/256 |
| 4,953,362 | 9/1990 | Shoji et al. | 312/116 X |
| 5,086,627 | 2/1992 | Borgen | 62/256 X |
| 5,301,517 | 4/1994 | Bustos | 62/265 X |
| 5,357,767 | 10/1994 | Roberts | 62/256 |
| 5,368,381 | 11/1994 | Mandel | 312/406.2 |
| 5,372,262 | 12/1994 | Benson et al. | 211/26 |

*Primary Examiner*—William E. Tapolcai
*Attorney, Agent, or Firm*—Richard G. Heywood

[57] ABSTRACT

A refrigerated merchandiser comprising an insulated cabinet defining a product zone and having an air cooling and circulating system for maintaining product zone temperatures, the insulated cabinet including a vertical section defining one side of the product zone, an interior frame for structurally supporting the vertical cabinet section, and a load-bearing external frame assembly for supporting the entire insulated cabinet including an external vertical frame located on the outside of the vertical cabinet section and being secured to the interior vertical frame.

23 Claims, 6 Drawing Sheets

REFRIGERATED MERCHANDISER WITH MODULAR EXTERNAL FRAME STRUCTURE

BACKGROUND OF THE INVENTION

1. Field of the Invention

This invention relates generally to the commercial refrigeration art, and more particularly to improvements in structural frame assemblies for food product merchandisers.

2. Description of Prior Art

Great advances have been made in the last forty years in the field of commercial food merchandising with improved insulation materials, better refrigerants, more efficient air handlers and condensing unit systems, better lighting and the universal use of ambient air temperature and humidity control in food stores and the like. A long checklist of important factors influence the construction and manufacture of food merchandisers including refrigeration requirements and performance, structural engineering for strength, durability and safety as well as insulation effect, servicing capability, product merchandising potential, and both manufacturing and operating costs.

In today's marketplace a wide variety of food merchandisers are used to best market different types of food products as well as meet their cooling needs. In the low temperature field, frozen food merchandisers maintain product display temperatures at about 0° F. and ice cream cases operate at about −5° F. to '10° F. Frozen foods are best protected in reach-in coolers (with glass front doors), but open front, multi-deck merchandisers best display various food products. Similarly, in the medium temperature field of 28° F. to 50° F. product temperature range, glass front deli merchandisers are generally preferred for the marketing of freshly cut meats, cheeses, prepared salads and other deli items, but open front multi-deck merchandisers are widely used for packaged meat and dairy products and single deck cases are preferred for fresh produce. Even with some industry standardization at eight (8') foot and twelve (12') foot lengths for merchandisers, the manufacture of each commercial refrigerator fixture has remained a hand built operation.

Each type of commercial refrigerated merchandiser in the past largely has been individually designed for a specific food display or storage purpose, and fabrication generally has been a custom assembly process. These prior art merchandisers have had bulky internal frame assemblies with normally heavy insulation positioned to span between the frame members and form an integral part of the inner cabinet cooling system. Commercial merchandisers conventionally use evaporator coils of the fin and tube type, which in the past have extended the full length of the merchandiser as was thought necessary to best achieve even, balanced air flow distribution for uniform air cooling from end-to-end throughout the length of the display area. It has been discovered that modular external support frame structures can effectively support most commercial merchandiser cabinets—whether single deck as in deli and produce types, or 2–5 multi-deck cases for frozen foods, fresh meats or dairy products. The modularity of such external frame structures of the present invention is accommodated by the use of shortened vertical length internal struts that only need to support the weight of insulated panels and duct forming members, and which, in turn, can accommodate a novel modular evaporator coil concept as disclosed more fully in a commonly assigned patent application of John A. Behr entitled Refrigerated Merchandiser With Modular Evaporator Coils and EEPR Control, co-pending herewith. The supporting frame structure of the present invention will accommodate conventional full length evaporator coil construction and placement as well as the newer modular coil concepts.

SUMMARY OF THE INVENTION

The invention is embodied in a refrigerated food merchandiser having an insulated cabinet with a product zone and having an air cooling and circulation system for maintaining product zone temperatures, the insulated cabinet including a vertical section defining one side of the product zone, an interior vertical frame for structurally supporting the vertical cabinet section, and a load-bearing external frame assembly for supporting the entire insulated cabinet including an external vertical frame located on the outside of the vertical cabinet section and being secured to the interior vertical frame.

It is a principal object of the present invention to provide a novel modular external frame structure that facilitates the modular design and fabrication of different commercial refrigerated merchandisers, that provides a full length, heavy duty base frame and internal and external frame sections, that accommodates different air cooling systems of conventional and modular design, that has a novel insulated cabinet panel system, and that accommodates ease of manufacture, installation and service. These and still other objects and advantages will become more apparent hereinafter.

DESCRIPTION OF THE DRAWINGS

In the accompanying drawings which form a part of this specification and wherein like numerals refer to like parts wherever they occur.

DESCRIPTION OF THE PREFERRED EMBODIMENT

Figure 1:
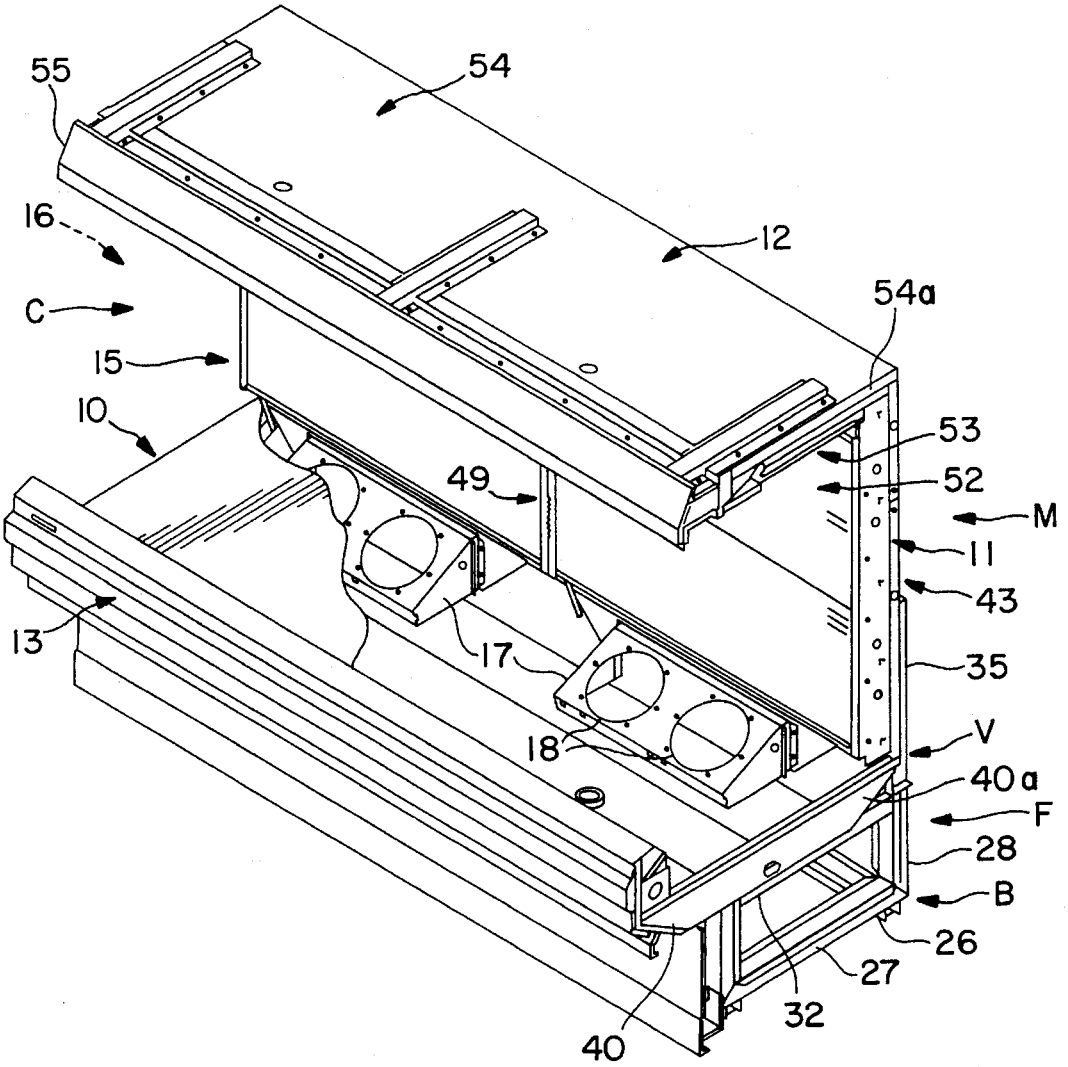
FIG. 1 is a perspective view, partly broken away, illustrating an open front multi-deck merchandiser embodying the invention.
Figure 2:
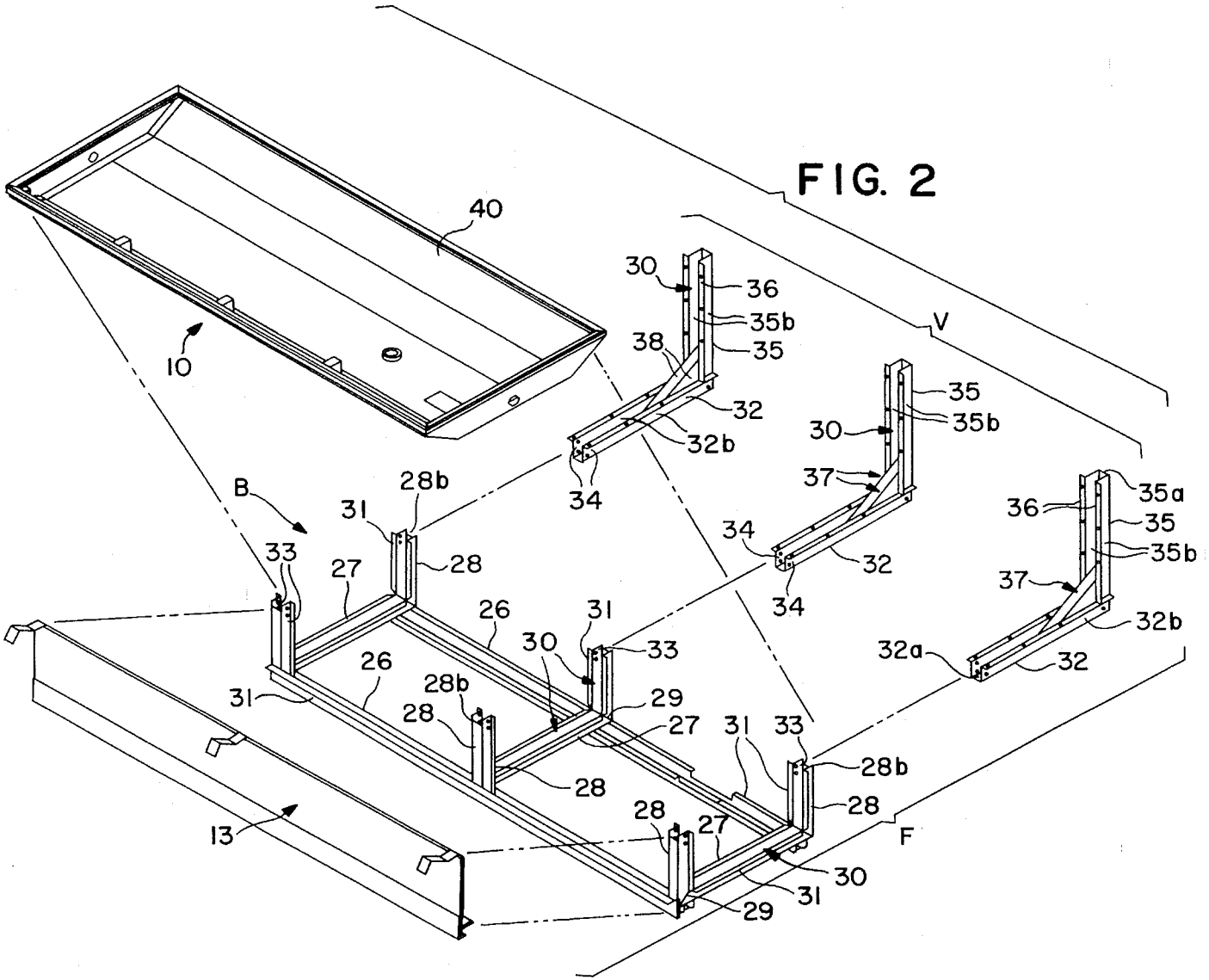
FIG. 2 is an exploded view of the base and external frame assembly of the FIG. 1 embodiment.

For disclosure purposes it will be understood that the modular structural frame assembly of the present invention is shown as applied in different commercial food display cases or merchandisers of the type installed in a typical supermarket. Such display cases are generally fabricated in standard eight (8') foot and twelve (12') foot lengths, but may be arranged in a multiple case line-up of several merchandisers operating in the same general temperature range. Low temperature refrigeration maintains display area temperatures of about 0° F. for frozen foods and medium temperature refrigeration maintains fresh food product area temperatures in the range of about 34° F. (red meat) to about 46° F. (produce). It is clear that the nature and thickness of insulation are design factors for low temperature and medium temperature merchandisers. It will also be understood that various commercial air cooling and control systems may be employed in the refrigerated merchandisers of the present invention, and do not form a direct part thereof.

FIGS. 1–7 illustrate a preferred embodiment of the invention in which an open front merchandiser M basically comprises an upper insulated cabinet assembly C and a lower or external frame assembly F. The merchandiser M of FIG. 1—as selected for disclosure purposes—is a depiction of a four-deck display merchandiser having an eight (8') foot length and operating at medium temperature for the refrigerated display of packaged fresh red meat. The cabinet assembly C is typical of open front merchandisers in that it has a bottom section 10, a back or rear wall section 11, a top wall section 12, a short front wall section 13, and an end wall closure 14, thus defining a product display area or zone 15 accessible through the front opening (at 16) extending between the top wall section 12 and front wall section 13. The cabinet assembly C also houses air cooling and circulation means for maintaining design temperatures in the product zone 15, and which comprises air moving plenums 17 with one or more fans 18 (located in the bottom section 10), and evaporator coil means 19 (located in the back section 11). Air circulation in rear duct 20 in the rear wall section 11 and top duct 21 in the top wall section 12 distribute cold exit air from the evaporators 19 to a discharge honeycomb 22 from which a refrigerated air curtain is formed across the open front 16 and returned through a return air duct 23 in the front wall section 13 and bottom duct 24 in the bottom wall section 10 to the air moving plenums 17 for recirculation.

The modular evaporator coils 19 as disclosed—while of conventional fin and tube configuration—constitute an advance in the commercial merchandiser field and are standardized in modular four (4') foot lengths to accommodate more flexibility in placement and use with the modular framing of the present invention, as disclosed more fully in the commonly assigned and co-pending patent application of John A. Behr entitled Refrigerated Merchandiser With Modular Evaporator Coils and EEPR Control, previously referenced herein.

A principal feature of the present invention resides in the external structural frame F and its modularity for adoption and use on an entire line of commercial merchandisers. The external frame assembly comprises a base section B and a vertical section V, as shown best in FIG. 2. The base section has at least two longitudinal frame or rail members 26 which extend horizontally substantially the full length of the merchandiser M. The base section also includes at least two transversely extending horizontal frame or strut members 27 (three being shown in FIG. 2) which are rigidly secured to span across the longitudinal rails 26 to form a heavy duty floor frame or base mounting means for the entire merchandiser M. Front and back vertical frame or riser members 28 are constructed and arranged at the front and back of each horizontal strut 27 to extend upwardly a predetermined distance for the selected cabinet assembly C to thereby locate the top of its front wall 13 at the appropriate elevation for shopper convenience in accessing the product zone 15. The mating edges of the horizontal struts 27 and vertical risers 28 are angle cut, at 29, and welded to form transverse unified U-shaped base frame subassemblies with the longitudinal rails 26. In the preferred embodiment, these frame members are channel-shaped, at 30, with a "hat" cross-section having outward extending flanges 31. The tops of the bottom channel wall **28*a* of each riser 28 is notched, at 28*b*, to receive a horizontal frame member 32 of the vertical section V, and the upper side walls 28*c* of the risers 28 are predrilled, at 33, for mating alignment with similar predrilled holes 34 and assembly with the frame members 32**.

A vertical section V is provided for each transverse base frame subassembly (27, 28). Each vertical section V of the external frame assembly F, in addition to its horizontal frame or leg members 32, includes a vertical frame or leg member 35 also of channel-shaped hat section (30) having a bottom wall **35*a* and opposed side walls 35b with outward flanges 36. As shown best in FIG. 5, the horizontal frame leg 32 and the vertical frame leg 35 are unified by a pair of similar opposed triangular wedge braces 37 positioned in side-by-side relationship between the opposed side walls 35*b* of the vertical leg 35 and the opposed side wall 32*b* of the horizontal leg 32. Each brace 37 has a triangular side wall 38 with vertical and horizontal flanges 38*a* and 38*b* for engagement with and attachment to the vertical bottom wall 35*a* of vertical frame member 35 and the horizontal bottom wall of horizontal flange member 32. Thus, the horizontal frame leg 32 and the vertical frame leg 35** of the vertical section V are rigidly secured together.

It will now be clear that the base section B is constructed and arranged to form a horizontal support structure with vertical stanchions or risers 28 selected to establish the desired cabinet elevation. The vertical section V is rigidly secured to the base section B and forms a horizontal cabinet supporting seat on its flanges **32*b* for the cabinet bottom wall 10 which has a molded insulated shell 40 with a sculpted or angled rearward edge 40*a* complementary to the angle of the brace member side wall 38. It will also be clear that the vertical frame legs 35 of the longitudinally spaced vertical sections V are constructed and arranged for supporting abutment with the back wall section 11** of the merchandiser cabinet C.

Figure 3:
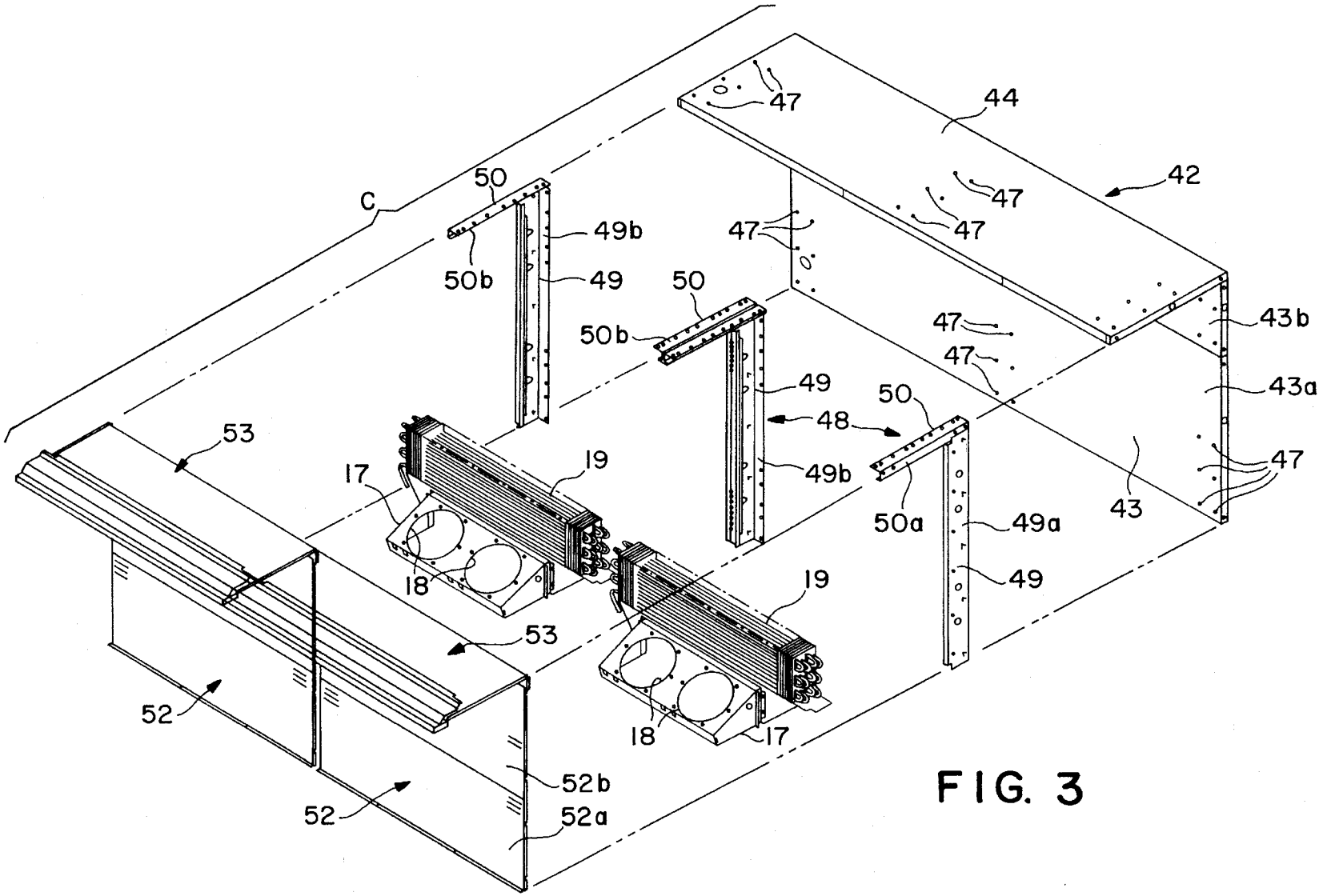
FIG. 3 is an exploded view of the insulated cabinet assembly and air cooling features of the FIG. 1 embodiment.
Figure 4:
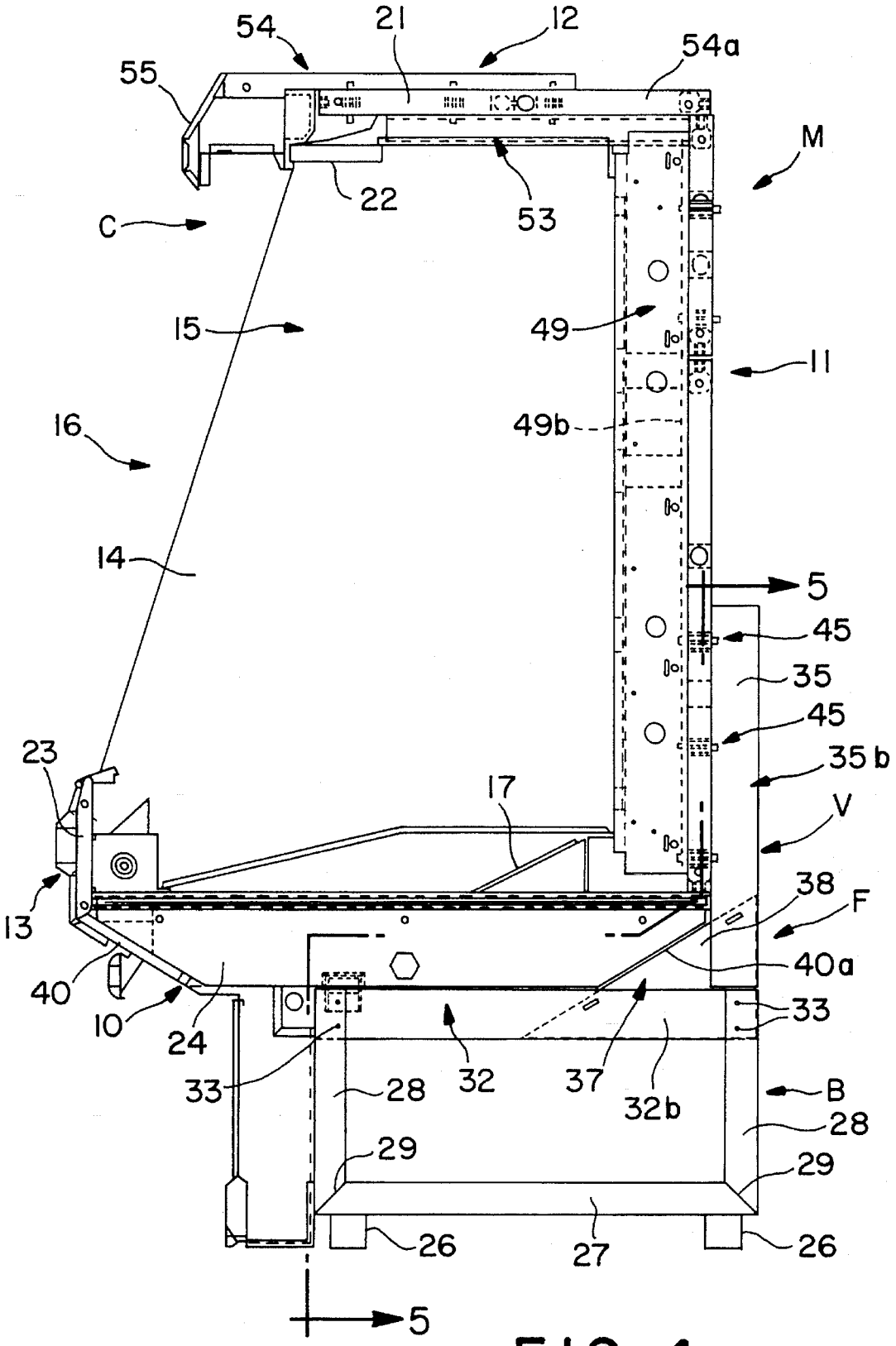
FIG. 4 is an end elevational view of the FIG. 1 merchandiser.
Figure 5:
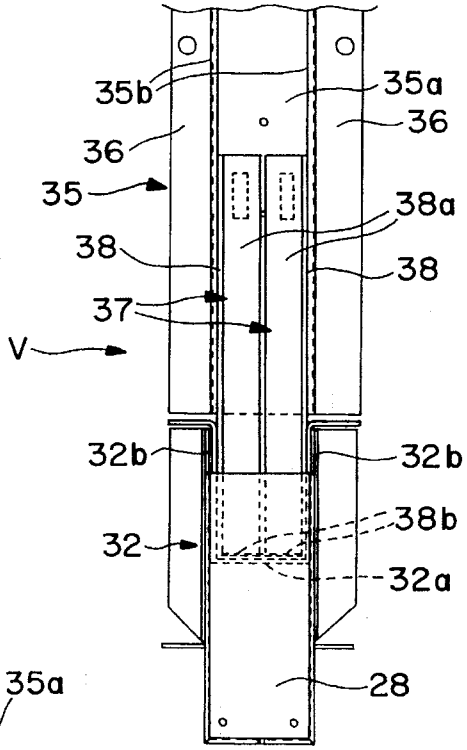
FIG. 5 is an enlarged view of the external frame assembly, as taken substantially along line 5—5 of FIG. 4.
Figure 7:
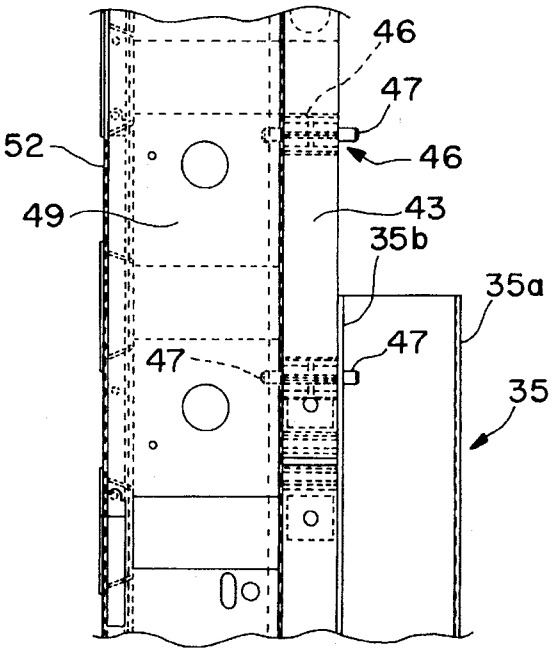
FIG. 7 is an enlarged fragmentary cross-sectional view of a typical cabinet back panel and air duct assembly.
Figure 6:
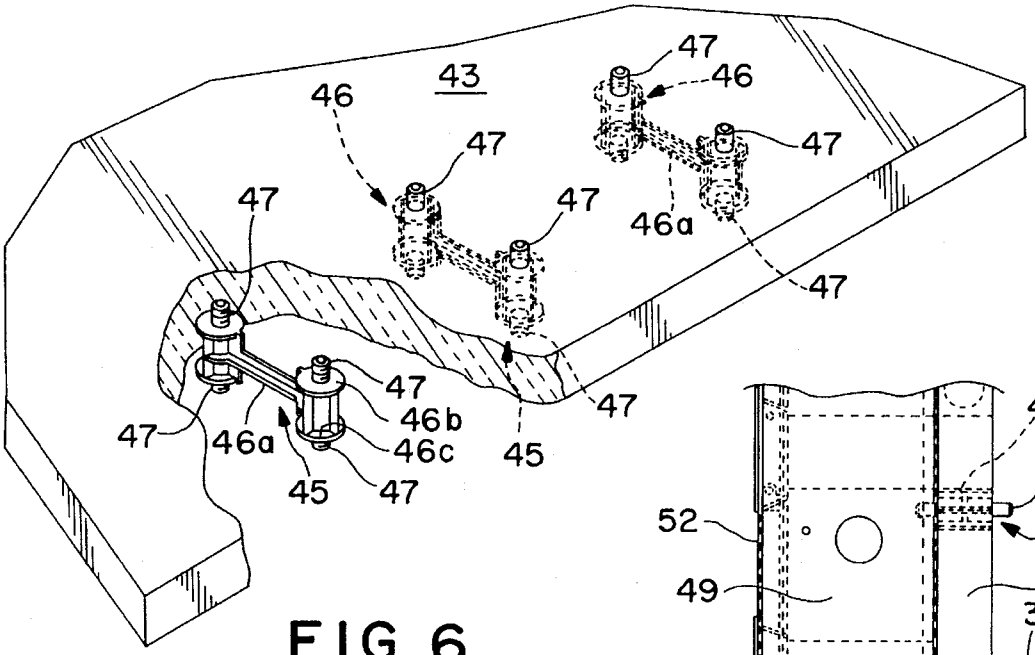
FIG. 6 is a greatly enlarged fragmentary perspective view, partly broken away, showing an insulated cabinet panel with imbedded frame mounting means.

Referring particularly to FIGS. 3, 6 and 7, the insulated cabinet C is constructed and arranged with a novel back wall and top wall assembly. A flat foamed outer or back insulated panel assembly 42 includes a lower vertical panel section 43 and an upper horizontal panel section 44. The lower back panel 43 may be formed in several modular sections **43*a*, 43*b* to establish the selected height for the merchandiser M. During the foaming formation of these panels (43, 44), frame mounting means 45 are molded into the panels. One embodiment of such mounting means 45 provides a dual-body fastener 46 with a connecting web 46*a*, and each body is molded around a through bolt 46*b* to form outwardly projecting threaded studs 47. As shown best in FIG. 6, the body portions 46 of the mounting means 45 have enlarged circumferential ends forming outer end surfaces 46*b* and inner lands 46*c* to thereby oppose stresses that would tend to displace or move the mounting means or break the panel. The essence of the studded mounting means 46, 47 is for it to be constructed and arranged to be embedded within the foam panel and rigidly held in place therein. The back wall and top wall assembly also includes interior frame means 48 for structural support and which includes a vertical back panel leg 49 and a horizontal top panel leg 50. In FIG. 3 it will be seen that interior frame means 48 at the merchandiser ends comprises a single transverse I-beam member 49*a*, 50*a* having longitudinally extending back flanges 49*b*, 50*b*** whereas an intermediate frame means 48 has dual beam walls and flanges. As will be apparent to those skilled in the commercial refrigeration art, the front flanges are constructed in a typical manner with vertically spaced slots (not shown) to adjustably receive shelf supporting brackets (not shown) for projecting into the display area 15 and mounting product shelving (not shown) thereon. The display area 15 is defined at its back by at least one inner vertical panel 52, which may have plural sections 52*a* and 52*b* corresponding to the vertical height requirements of the merchandiser M. The top of the display area is defined by at least one horizontal top panel 53.

Clearly, the internal frames 49 are assembled on the threaded studs 47 that inwardly project from the outer back panel 43, and the top panel 53 is similarly provided with mounting stud means to secure to the interior frame horizontal beam 50. The inner and top panels 52, 53 are secured between the corresponding sets of internal frame members 49, 50, and the top wall 12 is completed by a canopy structure 54 that includes an upper (outer) insulated panel 54*a* and which carries a lighting canopy 55 and the like, in FIG. 1.

The prior art merchandiser construction typically employed full height and depth structural end frames interconnected by full length structural pieces as part of the cabinet, and thus the full length evaporator coil configurations of the prior art were accommodated between the end frames in front of the insulated back wall structure. In the present invention, the inner and outer panels 52, 43 of the back wall section 11 are mounted on the internal vertical frame members 49, which are spaced longitudinally in four (4') foot placement to accommodate the modular coils 19 therebetween so that there will be one intermediate interior frame member 49 in an eight (8') foot merchandiser and two intermediate frame members 49 in a twelve (12') foot merchandiser. The vertical height of the internal frames 49 is predetermined to overlap the vertical dimension of the external vertical frame members 35 and provide a rigid structural connection therebetween by the fasteners 45 in the rear panel 43. It will be seen that the vertical internal frame members 49 are assembled on one side of the outer panel 43 and bolted onto the studs 47, and this section is then attached to the vertical external frame members 35 which receive the outwardly projecting studs 47 from the opposite (outer) panel side. The inner panel 52 can then be assembled on the internal frame members 49. Clearly, the canopy 54 and top wall section 12 are assembled on the internal frame members 50, and this weight, together with the additional weight of loaded product shelving, is carried by the vertical internal frame members 49 to the external vertical frame assembly V and thence to the base assembly B.

Figures 8, 9, 10:
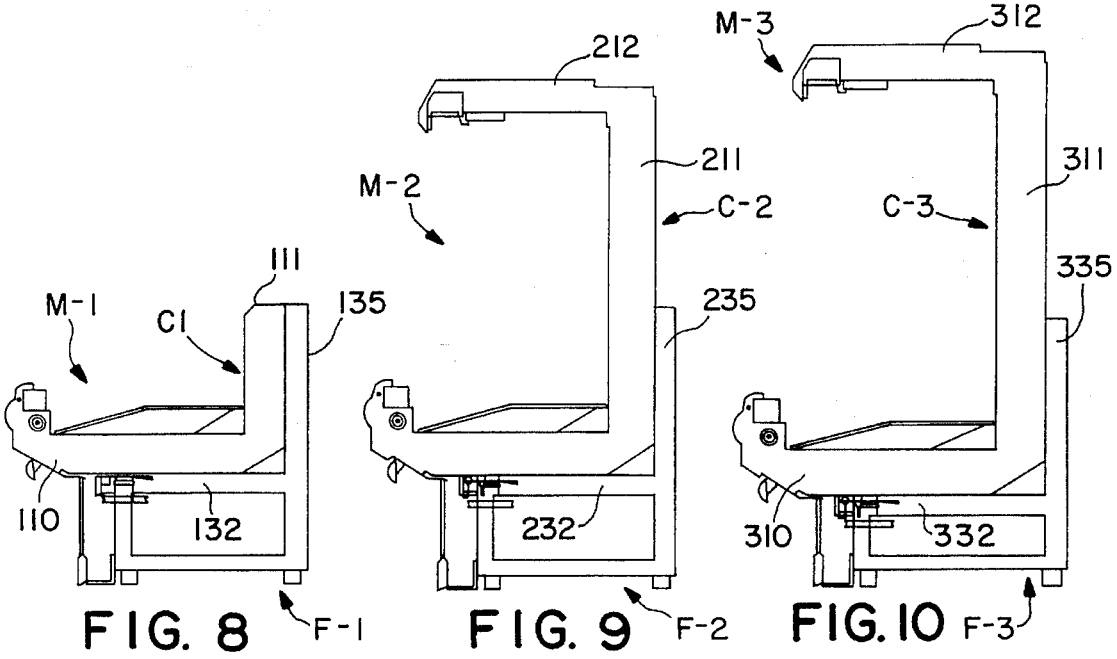
FIGS. 8–12 are diagrammatic cross-sections of different sized merchandisers embodying the invention.
Figures 11, 12:
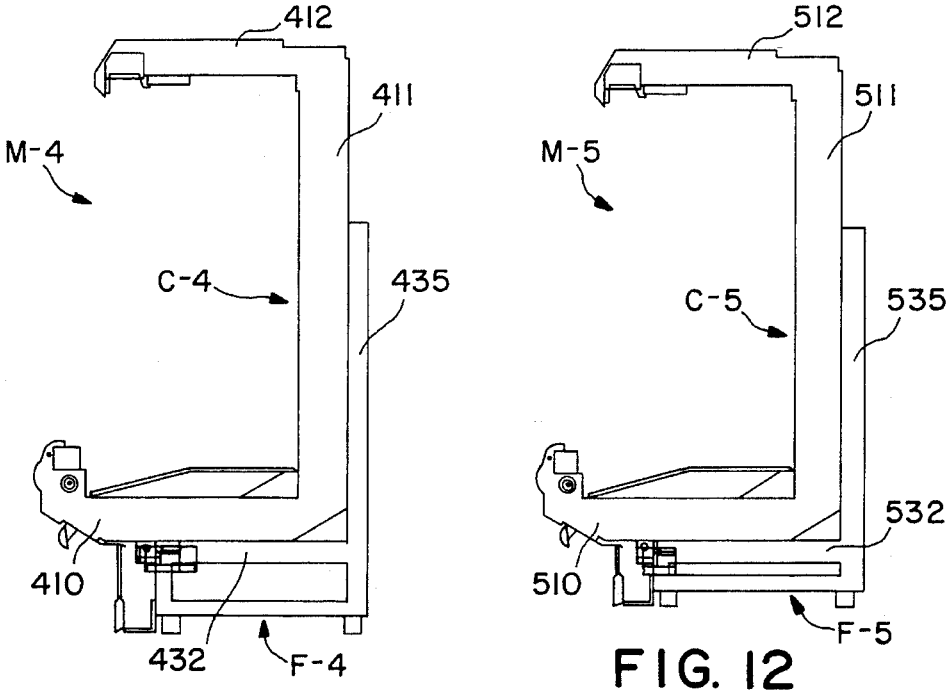

Referring now to FIGS. 8–12, it will be seen that the modular frame structure F of the present invention is applicable to an entire line of merchandisers. In FIG. 8, a single deck produce merchandiser M-1 has a cabinet C-1 with a short back wall section 111 and no top wall, and the cabinet C-1 is assembled on the modular external frame F-1 with the cabinet bottom wall section 110 being disposed on the horizontal frame members 132 with the back wall section 111 abutting and attached to the vertical frame members 135. FIG. 9 illustrates a two-deck merchandiser M-2 with its higher profile cabinet C-2 (including top wall section 212) being assembled on modular frame F-2 in the same manner previously described. FIG. 10 shows a three-deck merchandiser M-3 with cabinet C-3 and external frame F-3; FIG. 11 shows a four-deck merchandiser M-4 with cabinet C-4 and external frame F-4; and FIG. 12 shows a five-deck merchandiser M-5 with cabinet C-5 and external frame F-5. It will be noted that the taller merchandisers M-4 and M-5 utilize longer (higher) vertical external frame members 435, 535 thereby providing adequate lateral attachment and support of the corresponding internal frame members (not shown). Further, the vertical outer and inner panels 43 and 52 and horizontal top wall panels 44 are made up in different modular sizes to selectively adjust the height and depth of the product area for the respective merchandisers. It will also be seen that the height adjustment riser members 528 of the five-deck merchandiser M-5 are shortened to thereby keep the overall vertical profile of the product display area fully accessible to shoppers.

The scope of the invention is intended to encompass such changes and modifications as will be apparent to those skilled in the art, and is only to be limited by the scope of the appended claims.

What is claimed is:

1. A refrigerated merchandiser comprising insulated cabinet means defining a product zone and being constructed and arranged with air cooling and circulating means for maintaining product zone temperatures, said insulated cabinet means including a vertical section defining one side of the product zone and having an insulated vertical wall panel, and internal frame means for structurally engaging one side of the vertical wall panel; and a load-bearing external frame assembly for supporting the insulated cabinet means including horizontal base means, and vertical external frame means constructed and arranged for structurally engaging the other side of said vertical wall panel and translating cabinet load to the horizontal base means.

2. The merchandiser of claim 1, in which said external frame assembly has a base frame section and a vertical frame section, and said horizontal base means forms a part of said base section and comprises at least two longitudinally extending rail members spanning the length of the merchandiser cabinet.

3. The merchandiser of claim 2, in which said base frame section further comprises horizontally extending strut members traversing said rail members and being rigidly secured thereto.

4. The merchandiser of claim 3, in which said base frame section further comprises vertically extending riser members secured with said strut members to said rail members and defining an open U-shaped formation constructed and arranged for seating the cabinet means.

5. The merchandiser of claim 2, in which said vertical external frame means forms a part of said vertical frame section of said external frame assembly, and comprises at least two vertical leg frame members extending upwardly from said base frame assembly.

6. The merchandiser of claim 5, in which said vertical frame section further comprises a horizontal leg frame member rigidly secured at one end to each vertical leg frame member.

7. The merchandiser of claim 6, in which said vertical and horizontal leg frame members are assembled at their juncture by wedge brace means.

8. The merchandiser of claim 5, in which said vertical frame section comprises at least two horizontal frame members traversing said rail members and being rigidly secured thereto.

9. The merchandiser of claim 6, in which said base frame section includes vertical riser members extending upwardly from said rail members a predetermined distance, and said horizontal leg frame members being constructed to traverse pairs of said riser members and being secured thereto and adapted for seating said cabinet means.

10. A refrigerated merchandiser for food products having insulated cabinet means defining a product zone and being constructed and arranged with interior air cooling and circulating means for maintaining predetermined product temperatures within said product zone; comprising an external frame structure for supporting said insulated cabinet, said frame structure including base means having a pair of longitudinally extending front and rear rail members spanning the length of the merchandiser cabinet, and external cabinet-engaging frame means with longitudinally spaced horizontal frame members transversely oriented across said front and rear base members and being rigidly secured thereto, and longitudinally spaced vertical frame members secured to the rearward ends of at least two horizontal frame members to extend upwardly therefrom and form an L-shaped open frame support for supporting engagement by the bottom and rear walls of the insulated cabinet means.

11. The merchandiser of claim 10, in which said cabinet means comprises inner and outer vertical panel means, internal frame means connecting said inner and outer panel means in spaced relation to define an air passage therebetween as part of the air circulating means, and said internal frame means being constructed and arranged for connection to said external frame structure.

12. The merchandiser of claim 11, in which said internal frame means includes at least two vertical frame members in longitudinally spaced relation for orientation with and connection to corresponding vertical frame members of said external frame structure.

13. The merchandiser of claim 12, in which said outer vertical panel means is oriented between said internal frame members and said external vertical frame members, and connection means for interconnecting the internal and external frame members through the outer vertical panel means.

14. The merchandiser of claim 13, in which said connection means comprises a plurality of fastener body means embedded within the outer panel means and having exteriorly extending stud means constructed and arranged for assembling the internal and external frame members on opposite sides of said outer panel means.

15. The merchandiser of claim 14, in which said fastener body means each comprises at least one molded body portion embedded within said panel means and having said stud means extending through the center thereof and outwardly of the outer panel means in both directions.

16. The merchandiser of claim 15, in which said molded body portion of said connection means includes outwardly extending surface means for resisting displacement of said connection means from within the panel means.

17. The merchandiser of claim 13, in which said inner and outer vertical panel means includes at least two modular upper and lower panel sections constructed and arranged for selectively establishing the vertical height of the cabinet means.

18. The merchandiser of claim 17, in which the two modular panel sections are both secured to the internal vertical frame members, and at least the lower panel section also being secured to the external vertical frame members.

19. The merchandiser of claim 12, in which there is at least one intermediate internal vertical frame member and corresponding external frame member, said intermediate internal vertical frame member being in predetermined longitudinally spaced relationship with at least two other vertical frame members and defining rear wall air ducts of said air circulating means.

20. The merchandiser of claim 19, in which said air cooling means includes separate modular evaporator coils disposed in said rear wall duct means on opposite sides of said intermediate internal vertical frame member.

21. A commercial refrigerated merchandiser for food products having insulated cabinet means defining a product zone and being constructed and arranged with air cooling and circulating means for maintaining predetermined temperatures within said product zone; comprising an external frame structure for supporting said insulated cabinet, said external frame structure including base frame means having at least two longitudinal members and at least two transverse members rigidly connected together to form a horizontal floor frame and transversely aligned front and back riser members of predetermined length extending vertically from the floor frame whereby said base means defines a longitudinally open U-shaped foundation for the merchandiser cabinet, said external frame structure also including vertical frame means having horizontal leg means for bridging across said front and back riser members and being constructed and arranged for structurally supporting a preformed insulated bottom panel of said cabinet, and vertical leg means constructed and arranged for structurally supporting an insulated back panel of said cabinet.

22. The merchandiser of claim 21, in which the length of said vertical leg means is selectively variable to accommodate the structural support requirements for a class of merchandisers having different vertical profiles.

23. The merchandiser of claim 21, in which said vertical leg means is shorter than the back panel of said cabinet, and said back panel including internal vertical frame means having a lower portion constructed and arranged for connection to said vertical leg means for translating cabinet load thereto.

* * * * *

UNITED STATES PATENT AND TRADEMARK OFFICE

CERTIFICATE OF CORRECTION

PATENT NO. : 5,517,826

DATED : May 21, 1996

INVENTOR(S) : Martin J. Duffy

It is certified that error appears in the above-identified patent and that said Letters Patent is hereby corrected as shown below:

Column 8, line 45 (claim 23), after "the" insert --height of the--.

Column 8, line 50, add claims 24-27 as follows:

--24. The merchandiser of claim 1, in which the length of said vertical external frame means is selectively variable to accommodate the structural requirements for a class of merchandisers having different vertical profiles.

25. The merchandiser of claim 1, in which said vertical external frame means is shorter than the height of the vertical wall panel.

26. The merchandiser of claim 11, in which the length of said vertical frame members is selectively variable to accommodate the structural support requirements for a class of merchandisers having different vertical profiles.

UNITED STATES PATENT AND TRADEMARK OFFICE

CERTIFICATE OF CORRECTION

PATENT NO. : 5,517,826

DATED : May 21, 1996

INVENTOR(S) : Martin J. Duffy

It is certified that error appears in the above-indentified patent and that said Letters Patent is hereby corrected as shown below:

27. The merchandiser of claim 11, in which said vertical frame members are shorter than the height of the vertical panel means, and the internal vertical frame means having a lower portion constructed and arranged for connection to said vertical frame members for translating cabinet load thereto.--

Signed and Sealed this

Twenty-seventh Day of August, 1996

Bruce Lehman

*Attest:*

BRUCE LEHMAN

*Attesting Officer*

*Commissioner of Patents and Trademarks*